US010501948B2

(12) United States Patent
Lizarazu Zaldua et al.

(10) Patent No.: US 10,501,948 B2
(45) Date of Patent: Dec. 10, 2019

(54) HORIZONTAL FORMWORK ALLOWING FOR EXTENSION OF SUPPORT BASE

(71) Applicant: ULMA C y E, S. Coop., Oñati (ES)

(72) Inventors: Joseba Iñaki Lizarazu Zaldua, Legazpi (ES); Heriberto Zubia Uribeetxebarria, Arrasate (ES)

(73) Assignee: ULMA C Y E, S. COOP., Oñati (ES)

( * ) Notice: Subject to any disclaimer, the term of this patent is extended or adjusted under 35 U.S.C. 154(b) by 0 days.

(21) Appl. No.: 16/052,033

(22) Filed: Aug. 1, 2018

(65) Prior Publication Data

US 2018/0340342 A1 Nov. 29, 2018

Related U.S. Application Data

(63) Continuation of application No. PCT/EP2017/052203, filed on Feb. 2, 2017.

(30) Foreign Application Priority Data

Feb. 2, 2016 (EP) ..... 16382040

(51) Int. Cl.
*E04G 11/38* (2006.01)
*E04G 11/50* (2006.01)
(Continued)

(52) U.S. Cl.
CPC ..... *E04G 11/38* (2013.01); *E04G 11/486* (2013.01); *E04G 11/50* (2013.01); *E04G 25/06* (2013.01)

(58) Field of Classification Search
CPC ..... E04G 11/38; E04G 11/48; E04G 11/486; E04G 11/50
(Continued)

(56) References Cited

U.S. PATENT DOCUMENTS 4,123,032 A * 10/1978 Teschner ..... E04G 11/40 249/18
6,176,463 B1 * 1/2001 Rock ..... E04G 11/48 249/18
(Continued)

FOREIGN PATENT DOCUMENTS

DE 102016204633 A1 * 9/2017 ..... E04G 9/04
ES 8700375 A1 1/1987
(Continued)

OTHER PUBLICATIONS

International Search Report and Written Opinion of the International Searching Authority in corresponding International Application No. PCT/EP2017/052203, dated Mar. 8, 2017.

*Primary Examiner* — Michael Safavi
(74) *Attorney, Agent, or Firm* — Edell, Shapiro & Finnan, LLC

(57) ABSTRACT

A horizontal formwork is disclosed that includes a support base and a plurality of formwork panels that are supported thereon. The support base includes a plurality of basic grids that each have four heads arranged at the vertices of the basic grid. Two main beams are arranged parallel to one another, and two edge beams arranged parallel to one another and perpendicular to the main beams. Each basic grid also includes central beams which are arranged parallel to the edge beams and supported on the main beams. The main beams include housings adapted for receiving an end of a respective central beam. At least one of the basic grids includes at least one main beam having support sections for additional beams for supporting the formwork panels.

20 Claims, 15 Drawing Sheets

(51) Int. Cl.
*E04G 11/48* (2006.01)
*E04G 25/06* (2006.01)

(58) Field of Classification Search
USPC ..... 249/18
See application file for complete search history.

(56) References Cited

U.S. PATENT DOCUMENTS

| | | | | |
|---|---|---|---|---|
| 2014/0223853 | A1* | 8/2014 | Rosati | E04G 17/001 52/742.14 |
| 2015/0322675 | A1* | 11/2015 | Shih | E04C 5/06 52/848 |
| 2016/0060882 | A1* | 3/2016 | Bond | E04G 11/38 264/34 |
| 2019/0085571 | A1* | 3/2019 | Schneider | E04G 9/04 |

FOREIGN PATENT DOCUMENTS

| | | | |
|---|---|---|---|
| FR | 2136813 | A5 | 12/1972 |
| JP | S6088760 | A | 5/1985 |
| JP | S63206559 | A | 8/1988 |
| WO | 02084050 | A1 | 10/2002 |
| WO | 2008119848 | A1 | 10/2008 |

* cited by examiner

HORIZONTAL FORMWORK ALLOWING FOR EXTENSION OF SUPPORT BASE

CROSS-REFERENCE TO RELATED APPLICATIONS

This application relates to and claims the benefit and priority to International Application No. PCT/EP2017/052203, filed Feb. 2, 2017, which claims the benefit and priority to European Application No. EP16382040.0, filed Feb. 2, 2016.

TECHNICAL FIELD

The present invention relates to horizontal formworks.

BACKGROUND

Flexible or non-modular formworks in which the different parts forming the formwork do not have fixed positions and are assembled depending on the needs of the formwork are known. Such systems are very flexible but have low assembling and disassembling efficiencies.

On the other hand, modular formworks in which the positions of the elements are fixed are known. Such systems offer high assembling and disassembling efficiencies and furthermore the assembling and disassembling processes are safer than in non-modular formworks. In contrast, such systems have the drawback that they are systems with reduced flexibility.

For example WO 02/084050 A1 discloses a modular horizontal formwork comprising a plurality of grids. Each grid comprises four heads arranged at the vertices of the grid, each head being supported by a respective prop. Each basic grid further comprises two main beams arranged parallel to one another, each end of the main beams being supported on one of the heads, and two edge beams arranged parallel to one another and perpendicular to the main beams, each end of the edge beams being supported on one of the heads. The main beams comprise supports for panels on which the formwork panels are arranged.

ES 8700375 A1 discloses a modular horizontal formwork comprising a plurality of grids. Each grid comprises four heads arranged at the vertices of the grid, each head being supported by a respective prop. Each basic grid further comprises two main beams arranged parallel to one another, each end of the main beams being supported on one of the heads, and two edge beams arranged parallel to one another and perpendicular to the main beams, each end of the edge beams being supported on one of the heads. Each of the main beams comprises a housing at each longitudinal side. Each basic grid further comprises a central beam supported by the respective housings.

FR 2136813 A5 discloses a modular horizontal formwork comprising a plurality of grids. Each grid comprises four heads arranged at the vertices of the grid, each head being supported by a respective prop. Each basic grid further comprises two main beams arranged parallel to one another, each end of the main beams being supported on one of the heads, and two edge beams arranged parallel to one another and perpendicular to the main beams, each end of the edge beams being supported on one of the heads. Each of the main beams comprises a longitudinal support surface at each longitudinal side, such that central beams can be supported on the support surfaces.

JP S63206559 A discloses a modular horizontal formwork comprising a plurality of grids. Each grid comprises four heads arranged at the vertices of the grid, each head being supported by a respective prop. Each basic grid further comprises two main beams arranged parallel to one another, each end of the main beams being supported on one of the heads, and two edge beams arranged parallel to one another and perpendicular to the main beams, each end of the edge beams being supported on one of the heads. Each of the main beams comprises a longitudinal central part and a support surface on each longitudinal side of the central part. The support surfaces are disposed at a height lower than the central part such that central beams can be supported on either side of the central part.

SUMMARY OF THE DISCLOSURE

According to one embodiment a horizontal formwork is provided that comprises a support base and a plurality of formwork panels which are supported on the support base. The support base comprises a plurality of basic grids. Each basic grid comprises four heads arranged at the vertices of the basic grid, each head being supported by a respective prop. Each basic grid further comprises two main beams arranged parallel to one another, each end of the main beams being supported on one of the heads, and two edge beams arranged parallel to one another and perpendicular to the main beams, each end of the edge beams being supported on one of the heads.

Each basic grid also comprises a plurality of central beams which are arranged parallel to the edge beams and supported on the main beams, the main beams comprising housings adapted for receiving an end of a respective central beam.

The formwork panels are supported on respective support surfaces of the edge beams and the central beams.

At least one basic grid comprises at least one main beam comprising a plurality of support sections for additional beams for supporting the formwork panels. The support sections comprise a support surface for additional beams which is arranged below the formwork panels, allowing, if necessary, additional beams to be supported on the support surface projecting on both sides of the main beam, extending the support base by means of the portion of the additional beams projecting out of the basic grid.

As the additional beams project on both sides of the main beam, same sized additional beams can be used to extend the support base adapting it to different areas. In order to do so, the portion of the additional beams that is necessary to cover the specific area is projected out of the basic grid, while the remaining portion projects towards the inside of the basic grid. This is not possible in the horizontal formworks of the prior art, because the main beams of the formworks can only support beams on one longitudinal side or the other.

Therefore, as a result of this configuration of the main beam, a modular system with flexibility for extending its support base longitudinally is provided, thereby being able to cover a remaining space in which an additional basic grid does not fit. The horizontal formwork is therefore a hybrid system combining the advantages of modular formworks with the advantage of longitudinal flexibility which is obtained with flexible formworks.

These and other advantages and features will become evident in view of the drawings and the detailed description.

DETAILED DESCRIPTION

A horizontal formwork 1 is disclosed herein that comprise a support base and a plurality of formwork panels 17 which are supported on the support base. The support base comprises a plurality of basic grids 10.

The basic grids 10 form a modular formwork. Furthermore, the horizontal formwork 1 can comprise extensions of the support base both in the longitudinal direction and the transverse direction adapting the support base to wall finishings, as shown, for example, in the embodiment of FIG. 1.

Figure 1:
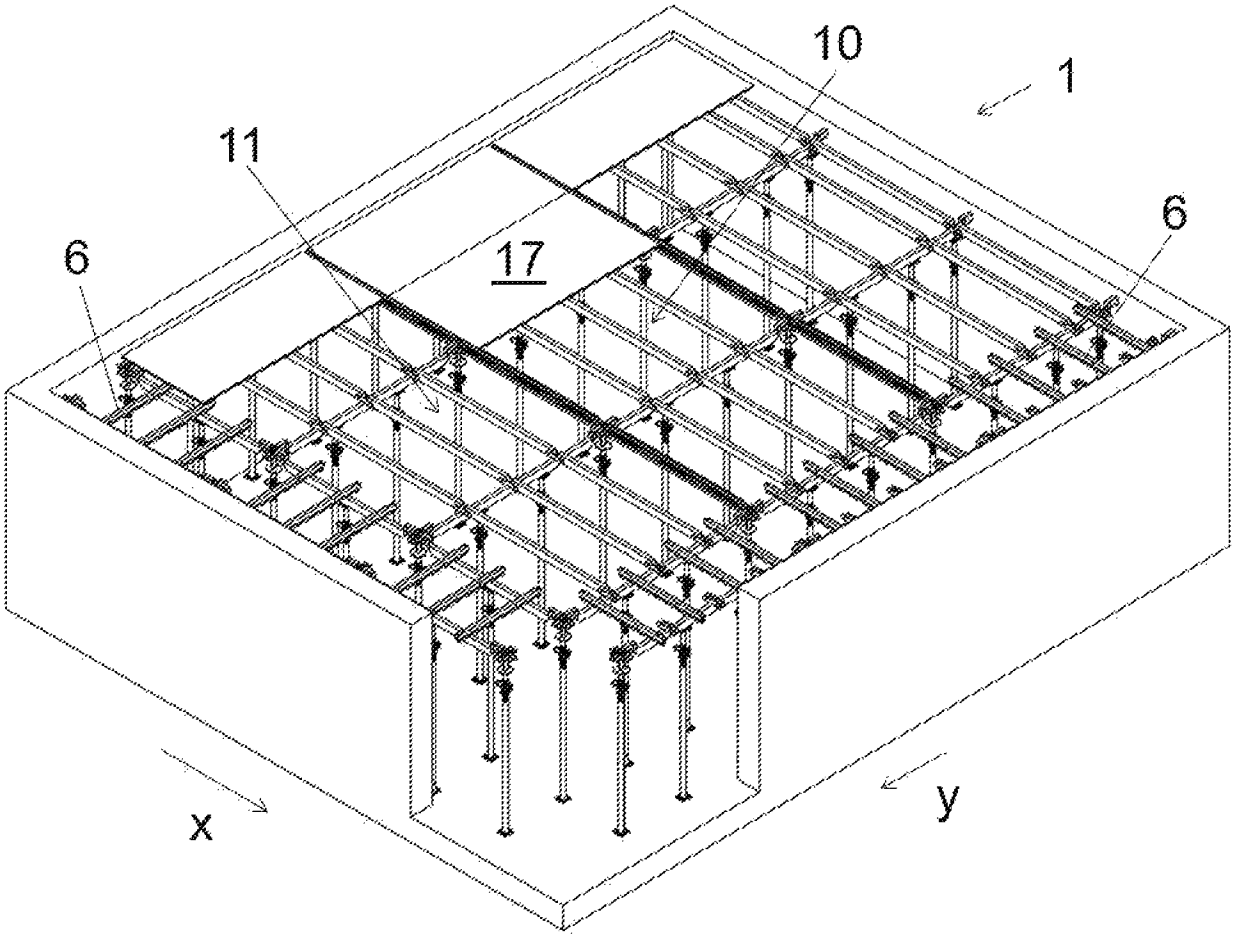
FIG. 1 shows a perspective view of the horizontal formwork according to a first embodiment, wherein the support base comprises, in addition to a plurality of basic grids and a plurality of edge grids, extensions of the support base both in the longitudinal direction and the transverse direction.

To understand this description, longitudinal direction will be considered the direction perpendicular to the main beams 3, i.e., the direction indicated with an "x" in FIG. 1, whereas transverse direction will be considered the direction parallel to the main beams 3, i.e., the direction indicated with a "y" in FIG. 1.

A horizontal formwork 1 can also comprise grids that are adapted to pillars, cantilever elements and hanging beams.

The horizontal formwork 1 offers the advantages of a modular formwork since a large part of the assembly is performed with basic grids 10, but at the same time offers a great adaptability since the basic grids 10 can be extended and/or combined with adaptable grids that are adapted to the support based on the previously indicated cases.

Figure 2:
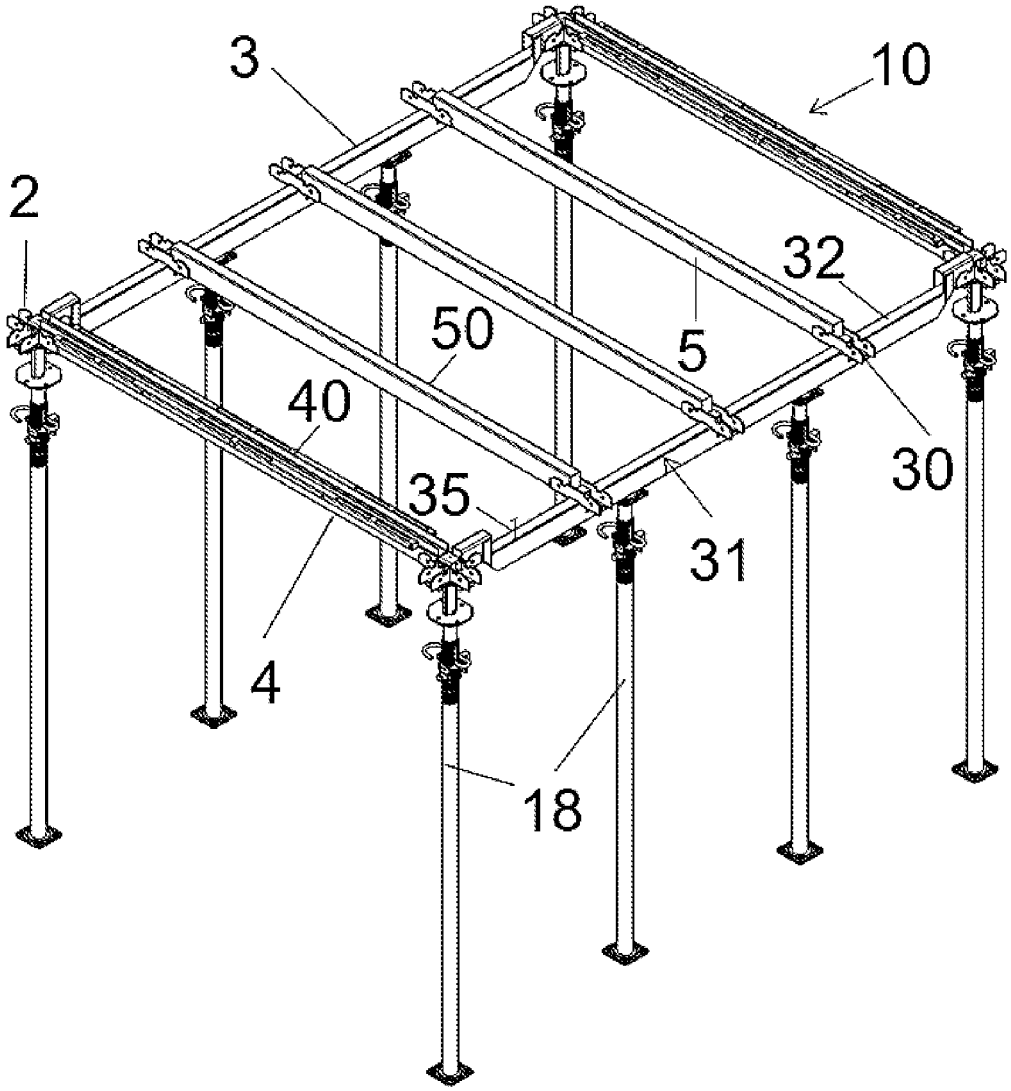
FIG. 2 shows a perspective view of a basic grid of the horizontal formwork shown in FIG. 1.
Figure 3:
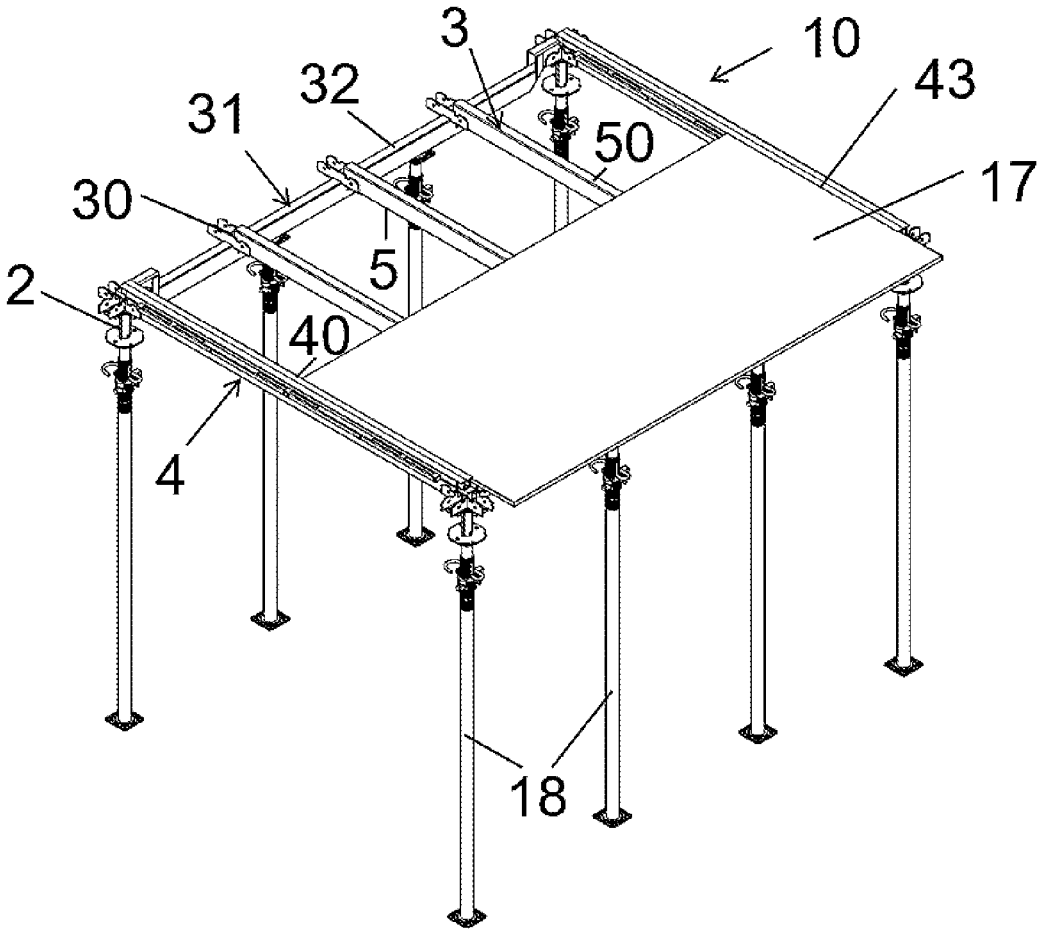
FIG. 3 shows a perspective view of a basic grid of the horizontal formwork shown in FIG. 1 with a formwork panel arranged on the basic grid.

FIGS. 2 and 3 show an embodiment of a basic grid 10.

A basic grid 10 comprises four heads 2 arranged at the vertices of the basic grid 10, each head 2 being supported by a respective prop 18.

The basic grid 10 also comprises two main beams 3 arranged parallel to one another, each end of the main beams 3 being supported on one of the heads 2, and two edge beams 4 arranged parallel to one another and perpendicular to the main beams 3, each end of the edge beams 4 being supported on one of the heads 2. Therefore, the main beams 3 and edge beams 4 form the perimeter of the basic grid 10, the heads 2 being arranged at the vertices of the basic grid.

The basic grid 10 also comprises a plurality of central beams 5, three in the embodiment shown in FIGS. 2 and 3, which are arranged parallel to the edge beams 4. The central beams 5 are supported on the main beams 3, to that end, the main beams 3 comprise housings 30 adapted for receiving an end of a respective central beam 5.

The formwork panels 17 arranged on the basic grids 10 are supported on respective support surfaces 40, 50 of the edge beams 4 and the central beams 5.

Figure 4:
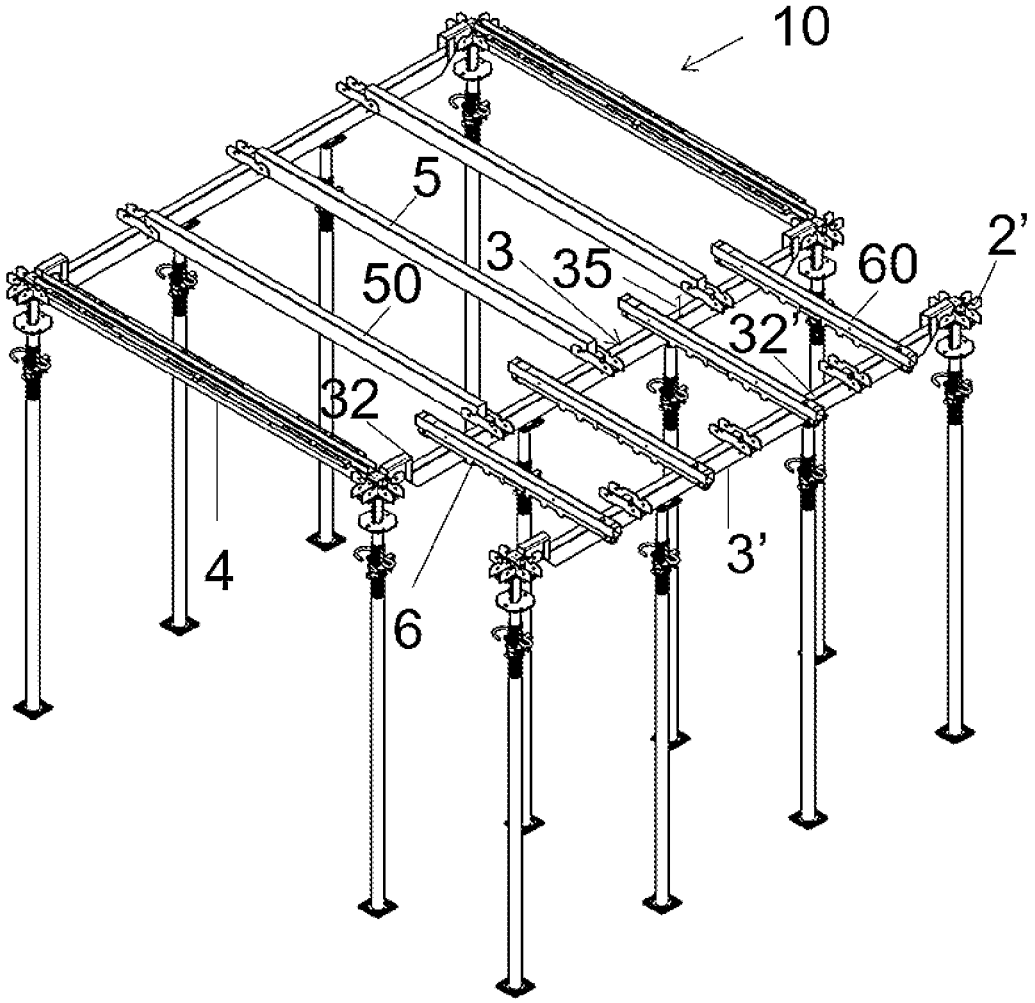
FIG. 4 shows a perspective view of a basic grid of the horizontal formwork shown in FIG. 1 with an extension of the support base in the longitudinal direction.

At least one basic grid 10 of the support base comprises at least one main beam 3 comprising a plurality of support sections 31 for additional beams 6 for supporting the formwork panels 17. The support sections 31 comprise a support surface 32 for additional beams 6 which is arranged below the formwork panels 17, allowing the additional beams 6 that are supported on the support surface 32 to project on both sides of the main beam 3, extending the support base by means of the portion of the additional beams 6 projecting out of the basic grid 10, as shown in FIG. 4.

Therefore, additional beams 6 can be overlapped on the support surfaces 32 of these main beams 3 since a gap 35 is created between the support surface 32 and the formwork panel 17 which allows arranging an additional beam 6 in the gap 35. The height of the gap is preferably 80 millimeters since the standard wood beams usually available in construction works tend to have that width and such standard beams can therefore be used as additional beams for extending the support base.

In the embodiments shown in the drawings, all the main beams 3 of the basic grids 10 are the same, i.e., all of the main beams 3 comprise a support sections 31 in addition to the housings 30. This provides the additional advantage of minimizing the number of different type of parts to be used in the formwork.

Modular formworks are easier to assemble and disassemble than flexible formworks, since the positions of the components are fixed. However, modular formworks have the drawback that they are not flexible when they come into contact with finishings, pillars, etc., and therefore there is usually a need to combine the same with other formwork systems in said areas. The horizontal formwork 1 is a hybrid system combining the advantages of modular formworks with the advantage of the longitudinal flexibility which is obtained with flexible formworks. The horizontal formwork 1 is modular because it is formed by basic grids 10, the positions of the components of each basic grid 10 being fixed, including the positions of the central beams 5, since they are supported on the housings 30 of the main beams 3. Furthermore, the support sections 31 of the main beams 3 provide the basic grid 10 with the possibility of overlapping additional beams 6 for extending the support base in the longitudinal direction, enabling the horizontal formwork 1 to be adapted for wall finishings, for example.

Figure 8:
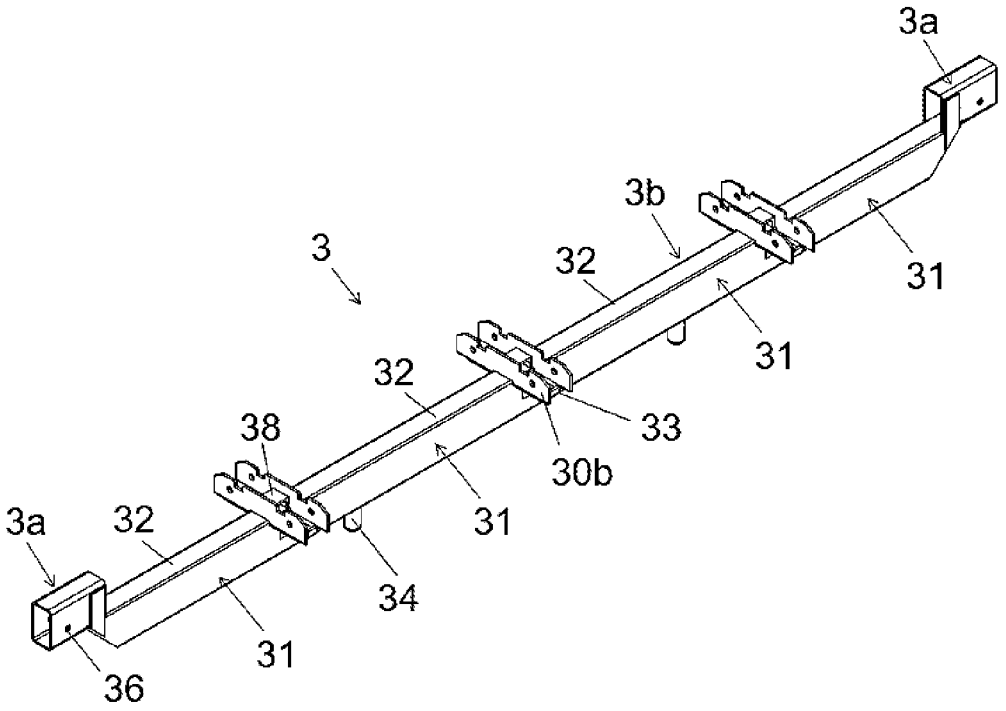
FIG. 8 shows a perspective view of a main beam of the basic grid shown in FIG. 2.

FIG. 8 shows in detail an embodiment of a main beam 3. The main beams 3 comprise an intermediate portion 3*b* and two ends 3*a*, the housings 30 and the support sections 31 being in the intermediate portion 3*b*, the intermediate portion 3*b* being arranged at a height lower than the ends 3*a*.

In this embodiment, the intermediate portion 3*b* of the main beams 3 comprises a support surface, the housings 30 being arranged on the support surface and the remaining of the support surface forming the support surfaces 32 of the support sections 31.

In this embodiment, the housings 30 of the main beams 3 are arranged equidistant from one another, the support sections 31 being arranged after the housings 30. The main beam 3 comprises housings 30 at each longitudinal side, since a main beam 3 can be shared by two adjacent basic grids, as shown in the embodiment shown in FIG. 1. The main beam 3 of this embodiment comprises six housings 30, three for each adjacent basic grid 10.

In this embodiment, each housing 30 of the main beams 3 comprises a rectangular base and two side walls 30*b* extending perpendicularly from the ends of the base, forming a U-shaped housing 30. Each housing 30 of the main beams 3 further comprises a coupling flange 33 extending perpendicularly from the base. Furthermore, in this embodiment the central beams 5 comprise a coupling window 51 in the proximity of each of the ends thereof such that the central beams 5 are coupled to the respective main beam 3 housing the coupling flange 33 of the main beam 3 in the respective coupling window 51 of the central beam 5.

In this embodiment, the main beam 3 comprises a plurality of projections 34 in its lower portion through which they are coupled to respective props 18 and which together with the props 18 which are coupled to the heads 2 support the weight of the basic grids 10.

Figure 6:
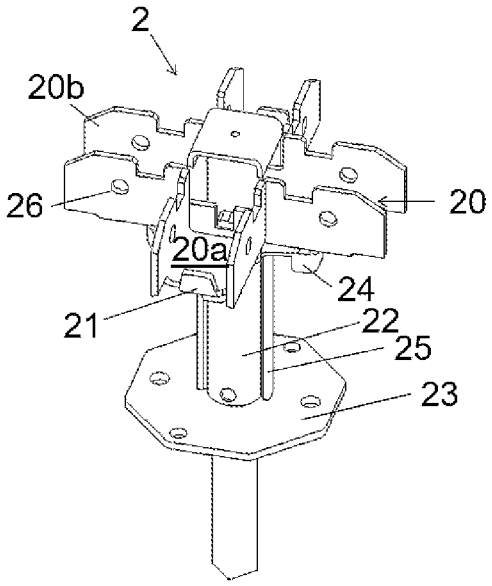
FIG. 6 shows a perspective view of a head of the basic grid shown in FIG. 2.
Figure 7:
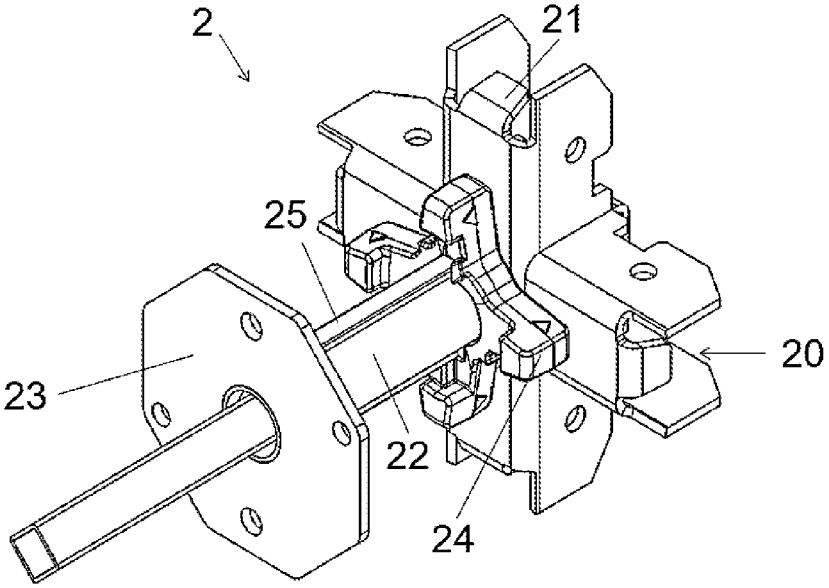
FIG. 7 shows another perspective view of the head of the basic grid shown in FIG. 2.

The head 2, shown in detail in FIGS. 6 and 7, comprises in this embodiment four housings 20 which are arranged orthogonal to one another and are adapted for receiving the end of a main beam 3 or the end of an edge beam 4. In fact, in this embodiment the four housings 20 of the head 2 are arranged at the same height and are adapted for receiving interchangeably the end of a main beam 3 or the end of an edge beam 4.

In this embodiment, each housing 20 of the head 2 comprises a rectangular base 20*a* and two side walls 20*b* extending perpendicularly from the ends of the base 20*a*, forming a U-shaped housing 20. Each housing 20 of the head 2 further comprises a coupling flange 21 extending perpendicularly from the base 20*a*.

Both the main beams 3 and the edge beams 4 of this embodiment comprise in each of their ends a coupling window such that each of the main beams 3 and edge beams 4 are coupled to in a housing 20 of a head 2 with a coupling flange 21 of the head 2 projecting into the respective coupling window.

In this embodiment, the head 2 is a drophead. Therefore, the head 2 comprises a fixed portion and a moving portion. The fixed portion comprises a central rod 22 and an abutment surface 23. The moving portion comprises a part comprising the four housings 20 of the head and a rotating wedge 24. The central rod 22 comprises two flat bars 25 which are arranged longitudinally on a portion of the central rod 22. The rotating wedge 24 comprises a housing copying the outer shape of the central rod 22 together with the flat bars 25. Depending on the radial position of the rotating wedge 24, when the central rod 22 and the flat bars 25 fit into the hole of the rotating wedge 24, the rotating wedge 24 will move down in a guided manner to the abutment surface 23 and along with the rotating wedge 24, the part with the housings 20. This type of drophead aids in disassembling the grid.

Figure 9:
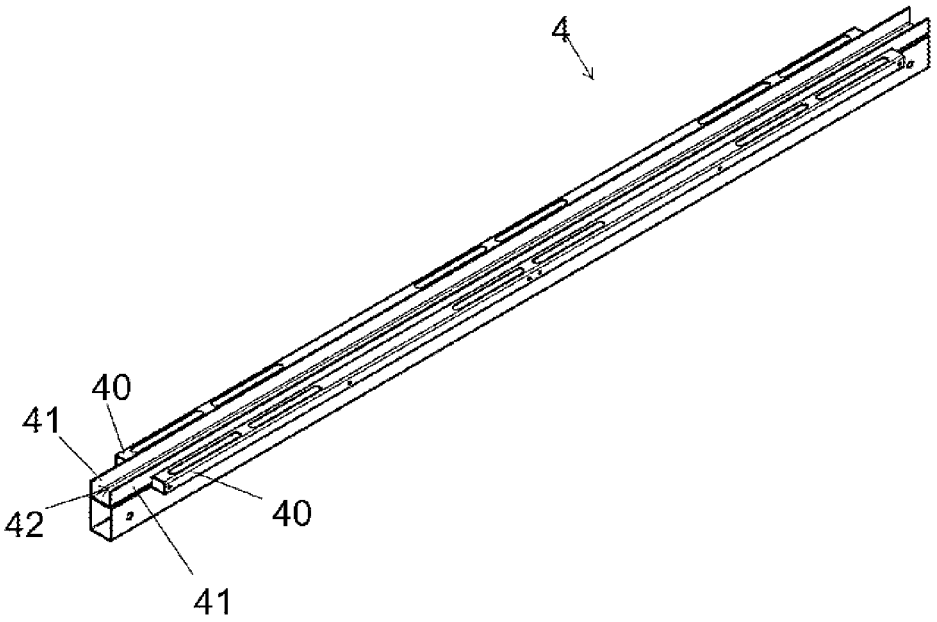
FIG. 9 shows a perspective view of an edge beam of the basic grid shown in FIG. 2.
Figure 10:
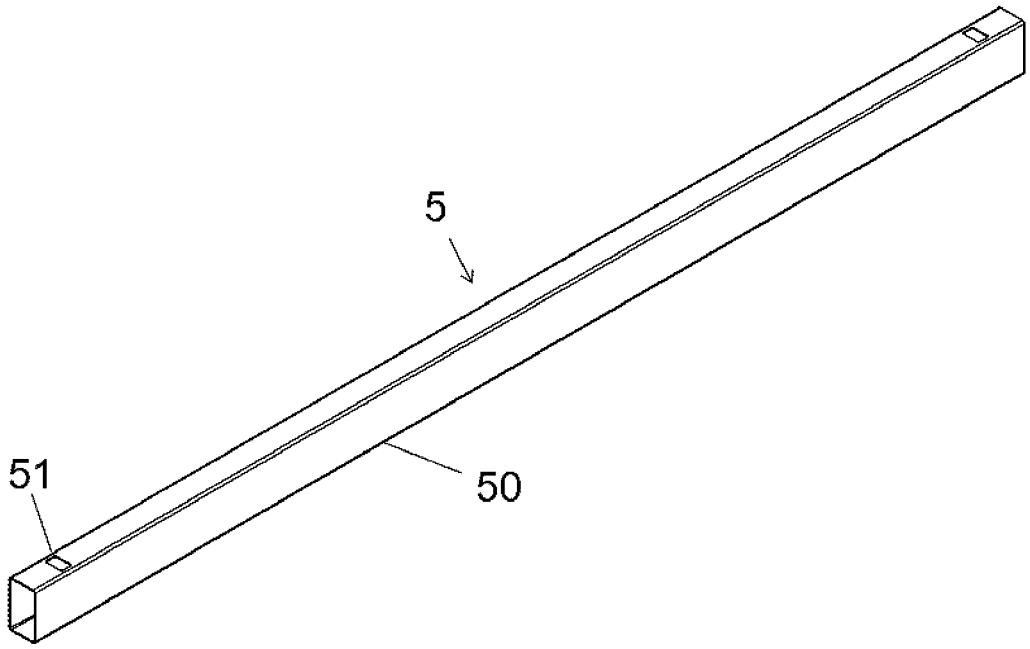
FIG. 10 shows a perspective view of a central beam of the basic grid shown in FIG. 2.

In this embodiment, the edge beam 4, shown in detail in FIG. 9, comprises at each longitudinal side the previously described support surface 40 on which the formwork panels 17 are supported, and an abutment wall 41, the support surface 40 and the abutment wall 41 forming a bracket at each longitudinal side of the edge beam 4. The bracket is adapted for receiving the end of a formwork panel 17, such that the opposing brackets of the two edge beams 4 forming a basic grid 10 form a track for the formwork panels 17. In this first embodiment, the combined length of the formwork panels 17 arranged on the basic grids 10 coincides with the distance between the opposing brackets of the two edge beams 4 forming a basic grid 10. Therefore, the formwork panels 17 are guided in the tracks and can only move in the longitudinal direction. A horizontal formwork which is safer for the operators is thereby achieved.

In this embodiment, the abutment walls 41 of the edge beams 4 form a housing 42 adapted for receiving a filler 43, such that the filler 43 can seal the gap formed between two adjacent formwork panels 17 in the longitudinal direction. The ends of the fillers 43 may be supported on the respective heads 2. The fillers 43 of two adjacent basic grids 10 are arranged in contact in the longitudinal direction such that they form a continuous surface once assembled.

A good finish is obtained with the horizontal formwork 1. On one hand, the formwork panels 17 are arranged in contact with one another in the longitudinal direction and on the other hand, the fillers 43 fill the gap between the formwork panels 17 in the transverse direction, achieving a continuous surface. It is suitable for the filler 43 to project as little as possible with respect to the formwork panels 17 so that the finish is good.

The manner in which the partial disassembly of a basic grid 10 according to this embodiment is performed is described below:

- The props 18 coupled to the main beams 3 are first removed.
- The heads 2 are then released from the wedge by rotating the rotating wedge 24. Therefore, the moving portions of the heads 2 move down and therefore the housings 20 of the heads 2 move down and together with the housings 20 the main beams 3, the edge beams 4, the central beams 5 and the formwork panels 17 move down. The fixed portions of the heads 2 do not move and therefore support the weight of the slab that is formed atop the formwork panels.
- The edge beams 4 are then removed.
- The central beams 5 and the formwork panels 17 are then removed.
- Finally, the main beams 3 are removed.

The slab will be supported by the props 18 supporting the heads 2. Since the ends of the fillers 43 are supported on the fixed portions of the heads 2, the fillers 43 will also be assembled until the complete disassembly in which they are removed together with the heads 2 and the respective props 18 thereof. Therefore, almost all the elements of the basic grids 10 can be removed once the slab acquires enough strength. The rest of the elements will be removed when the slab is completely dry. The embodiment shown in FIG. 1 shows a horizontal formwork 1 with wall finishings both in the longitudinal direction and the transverse direction.

When a horizontal formwork 1 is carried out in a space in which vertical walls have already been made, the horizontal formwork 1 must be adjusted to the vertical walls. As mentioned above, the horizontal formwork 1 is mainly carried out with basic grids 10 forming a modular formwork. What happens is that when the modular formwork is moved close to a wall, a space may remain between the basic grid 10 closest to the wall and the wall is insufficient for another basic grid 10 to fit in. The horizontal formwork 1 allows extending the support base up to the wall in a simple manner.

FIG. 4 shows in detail a wall finishing in the longitudinal direction. To carry out a wall finishing in the longitudinal direction, i.e., to adjust the support base to the wall in the longitudinal direction, the horizontal formwork 1 comprises a plurality of additional beams 6, each additional beam 6 being supported on a support surface 32 of a main beam 3 of a basic grid 10 and on a second support surface 32' external to the plurality of basic grids 10, the additional beams 6 extending the support base formed by the basic grid 10 longitudinally. The formwork panels 17 which are arranged on the extension of the support base are supported on the support surfaces 60 of the additional beams 6. The additional beams 6 are preferably arranged perpendicular to the main beam 3.

The horizontal formwork 1 allows to carry out wall finishings in the longitudinal direction with same sized additional beams 6, regardless of the space between the basic grid 10 closest to the wall and the wall. The additional beams 6 cannot project from the portion of the wall, so to enable carrying out finishings in spaces of different size with one and the same additional beam 6, the additional beam 6 must be able to project from the main beam 3 towards the inside of the basic grid 10 closest to the wall. This overlapping of the additional beam 6 with the main beam 3 allows the extension of the support base for covering the distance between the basic grid 10 closest to the wall and the wall.

In the embodiment shown in FIG. 4, the second support surface 32' of the additional beams 6 is a support surface 32' of an additional support beam 3' supported by props 18. In this embodiment, the additional support beam 3' is the same as the main beam 3 on which the additional beams 6 are supported and the ends of the additional support beam 3' are supported on respective heads 2' which are the same as the heads 2 of the basic grids 10.

Figure 11:
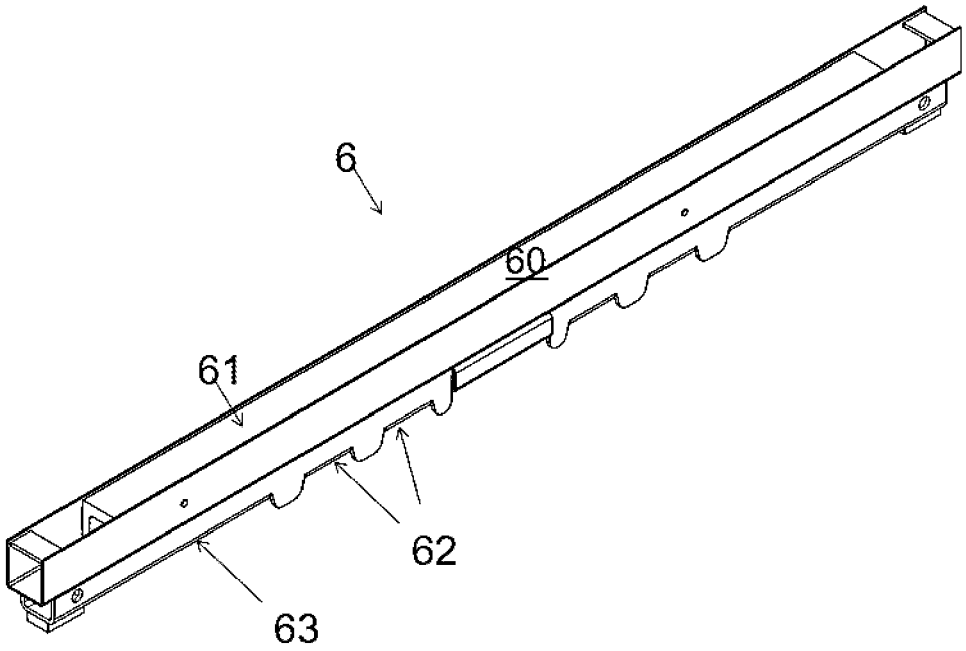
FIG. 11 shows a perspective view of an additional beam of the basic grid shown in FIG. 2.

In this embodiment, the additional beam 6 shown in detail in FIG. 11 comprises a plurality of grooves 62 in its lower portion adapted for fitting in the support sections 31 of the main beam 3 and in the additional support beam 3'. The additional beam 6 also comprises a continuous support section 63 which could be arranged on the support sections of the main beam 3 and on the additional support beam 3'.

The additional beams 6 of this embodiment comprise a nailing block 61, preferably made of plastic although it could also be made of wood. The nailing block 61 allows nailing the formwork panel 17 arranged on the additional beam 6 and the additional beam 6 itself. This operation may be necessary for safety reasons in certain spaces of the horizontal formwork.

In other possible embodiments, another type of additional beams, for example, standard wood beams that are usually available in all construction works can be used.

In other embodiments, the additional support beams 3' could be different from the main beams 3 as long as the additional beams 6 can be supported on the additional support beam 3' and the end of the additional beam 6 supported on the additional support beam 3' is flush with the end of the additional beam supported on the main beam 3 of the basic grid. Furthermore, in other embodiments other types of heads could be used as long as the heads on which the additional support beam is supported have two housings arranged at 180°, for example.

According to one embodiment, the main beams 3 are used as additional support beam 3' and the heads 2' are the same as the heads 2 of the basic grids 10, for reducing the number of different type of parts to be used for assembling the base support of the horizontal formwork 1.

In this embodiment, the main beam 3 and the additional support beam 3' are arranged parallel to one another but in other embodiments in which the wall has an inclination with respect to the main beam 3, the additional support beam 3' can be arranged parallel to the wall and therefore inclined with respect to the main beam 3.

Figure 5:
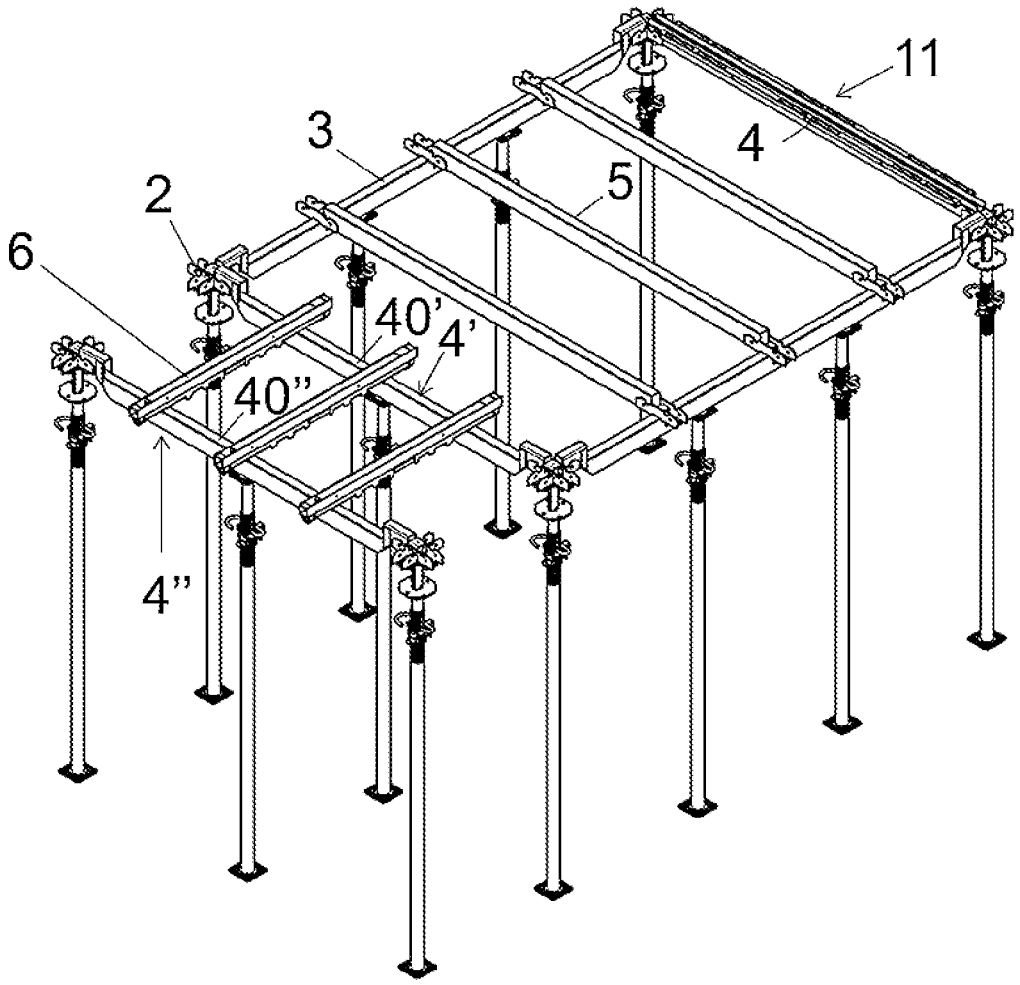
FIG. 5 shows a perspective view of an edge grid of the horizontal formwork shown in FIG. 1 with an extension of the support base in the transverse direction.

FIG. 5 shows in detail a wall finishing in the transverse direction. To carry out a wall finishing in the transverse direction, the support base comprises a plurality of edge grids 11 which are arranged contiguous to the basic grids and in the transverse direction at the end closest to the wall. The edge grids 11 differ from the basic grids 10 in that at least one edge beam 4, specifically the edge beam which is arranged closest to the wall, is replaced with a modified edge beam 4'.

Figure 12:
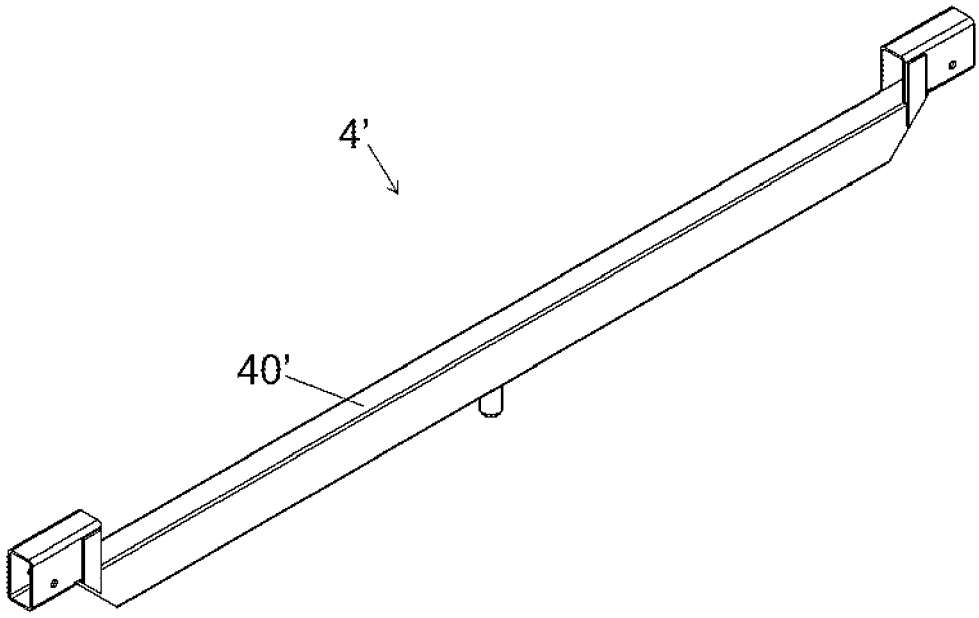
FIG. 12 shows a perspective view of a modified edge beam of the edge grid shown in FIG. 5.
Figure 13:
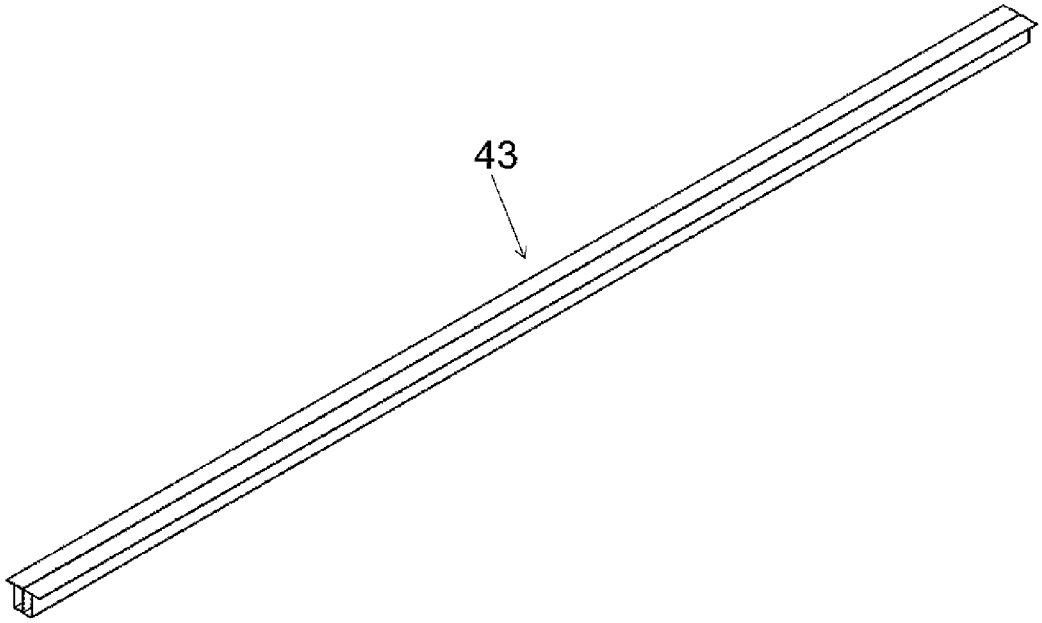
FIG. 13 shows a perspective view of a filler of the basic grid shown in FIG. 3.

The modified edge beam 4' of this embodiment shown in detail in FIG. 12 comprises a support surface 40' for additional beams 6 for supporting the formwork panels 17. The support surface 40' is arranged below the formwork panels 17, allowing the additional beams 6 to be supported on the support surface 40' projecting on both sides of the modified edge beam 4', extending the support base by means of the portion projecting out of the edge grid 11. The formwork panels 17 which are arranged on the extension of the support base are supported on the support surfaces 60 of the additional beams 6.

To carry out the wall finishing in the transverse direction, the support base therefore comprises a plurality of additional beams 6, each additional beam 6 being arranged supported on a support surface 40' of a modified edge beam 4' and on a second support surface 40" external to the plurality of grids 10 and 11, the additional beams 6 extending the support base formed by the grids 10 and 11 transversely. In this embodiment, the additional beams 6 are the same as those used in the wall finishing in the longitudinal direction, minimizing the number of different type of parts to be used in the horizontal formwork 1.

In the embodiment shown in FIG. 5, the second support surface of the additional beams 6 is a support surface 40" of an additional support beam 4" supported by props 18. In this embodiment, the additional support beam 4" is the same as the modified edge beam 4' on which the additional beams 6 are supported. Furthermore, the ends of the additional support beam 4" are supported on respective heads 2' which may be the same as the heads 2 of the basic grids 10.

The horizontal formwork 1, in addition to carrying out finishings on walls, allows carrying out springings on wall. If a basic grid 10 is arranged against a wall which is arranged parallel to the main beams 3 there is no problem since the formwork panel 17 can be supported on the basic grid 10 and against the wall. However, if a basic grid 10 is arranged against a wall parallel to the edge beams 4, there would be a gap between the edge beam 4 and the wall that must be covered with additional formwork panels. To that end, when a formwork is started adjacent to a wall parallel to the edge beams 4, springing grids adjacent to the wall are arranged. The springing grids differ from the basic grids 10 in that the heads closest to the wall are replaced with springing heads which are arranged below the main beams 3 and in that the edge beam 4 closest to the wall is dispensed with, only the other one being maintained. Therefore, the end of the main beams 3 closest to the wall being stuck to the wall, creating a lane for the formwork panels 17 between the wall and the edge beam 4 of the springing grid in which the formwork panels 17 fit. The springing head comprises a U-shaped housing for being coupled to the respective main beam 3 and two housings at 180° adapted for receiving the end of a central beam 5. A central beam 5 is supported on the housings of the springing head to give support to the formwork panels 17. The springing heads are shored up by means of a respective prop.

As mentioned above, in addition to finishing on walls, the horizontal formwork allows carrying out grids for bypassing pillars.

Figure 14:
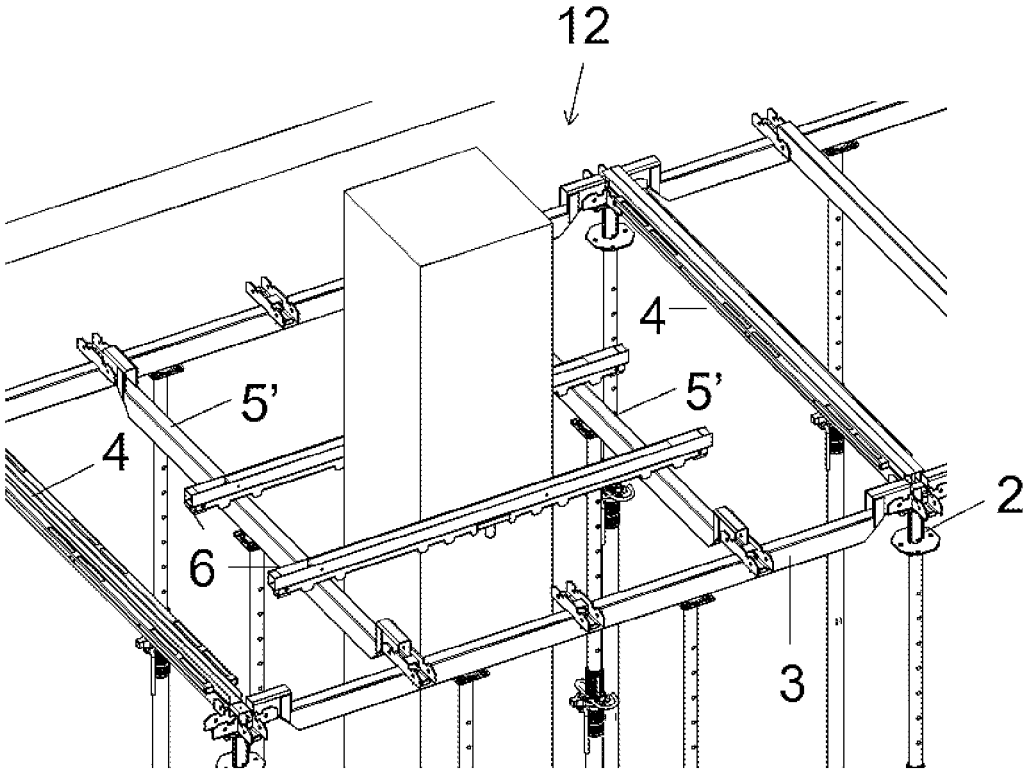
FIG. 14 shows a perspective view of an embodiment of a grid for bypassing a pillar.

FIG. 14 shows in detail an embodiment of a grid for bypassing a pillar 12.

Such grids are arranged between basic grids 10. The grid for bypassing a pillar 12 differs from the basic grids 10 in that, for bypassing a pillar arranged within the grid 12, at least two central beams 5 between which the pillar is arranged, are replaced with modified central beams 5'. The modified central beams 5' comprise respective support surfaces 50' on which additional beams 6 are supported. Therefore, the formwork panels 17 which are arranged on the grid for bypassing a pillar 12 are supported on the respective support surfaces 60, 40 of the additional beams 6 and the edge beams 4 of the basic grid 10. The additional beams 6 are arranged on both sides of the pillar. In this embodiment, the modified central beams 5' are shored up by means of a respective prop 18. In this embodiment, the central beam 5 that would be arranged flush with the pillar is omitted. In other embodiments in which the pillar is arranged between two central beams 5, it would not be necessary to omit any central beam 5. In other embodiments, depending on the width of the pillar, it may be necessary omit more than one central beam 5.

In this embodiment, the modified central beams 5' are the same as the modified edge beams 4' used in the edge grids 11. Furthermore, the additional beams 6 also are the same as those used in the extensions of the support base. Therefore, no special elements are needed for carrying out such grids.

Figure 15:
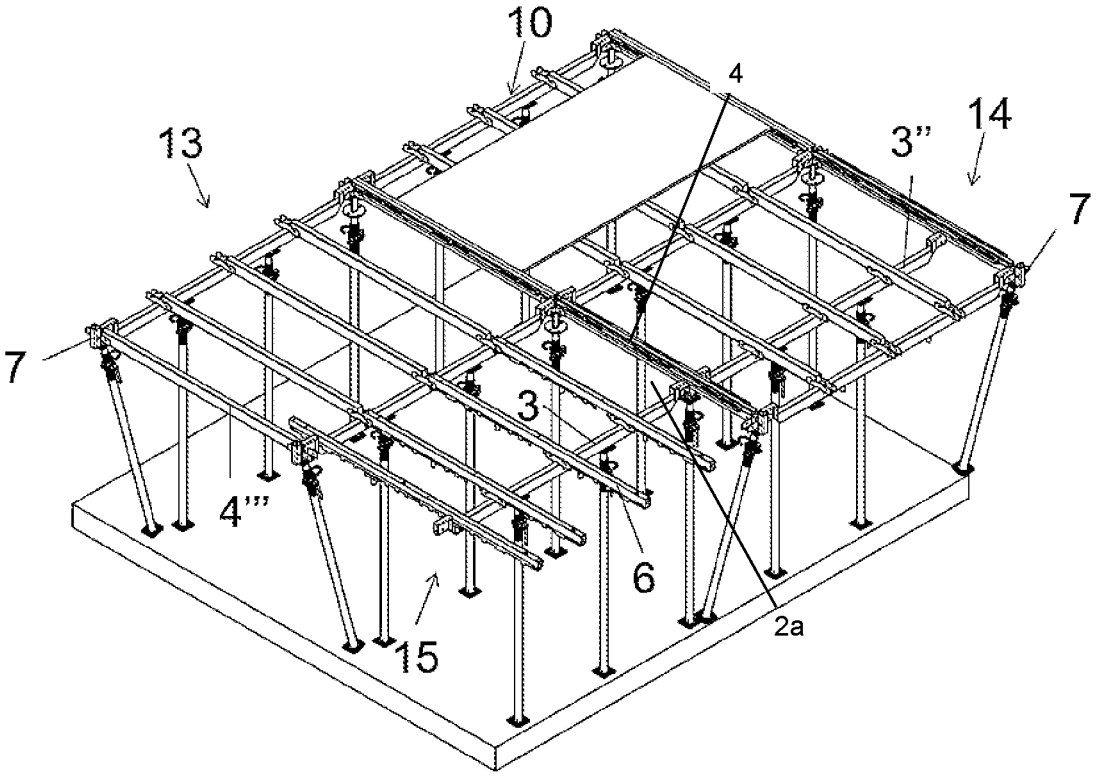
FIG. 15 shows a perspective view of the horizontal formwork according to a second embodiment of the invention, wherein the support base comprises, in addition to a basic grid, a plurality of cantilever grids.
Figure 16:
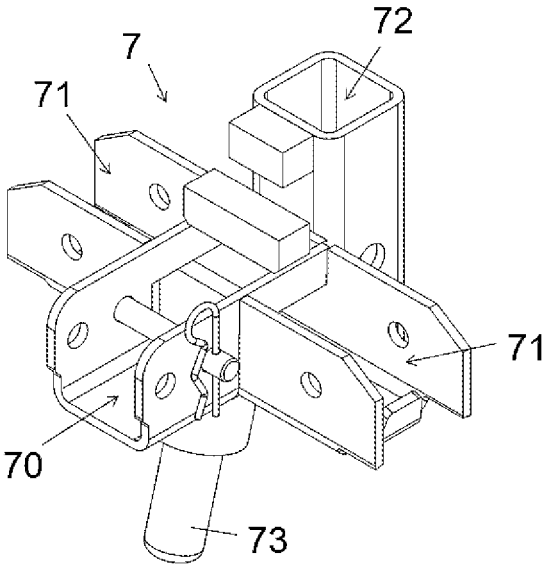
FIG. 16 shows a perspective view of a perimetral head of the cantilever grids shown in FIG. 15.

FIG. 15 shows an embodiment of a horizontal formwork 1 in which the support base comprises, in addition to a basic grid 10, a plurality of cantilever grids 13, 14 and 15. The cantilever grids 13, 14 and 15 are those in which a portion of the grid projects with respect to the slab in which the support base is arranged.

A transverse cantilever grid 13 differs from the basic grids 10 in that the edge beam 4 arranged in a cantilever manner is replaced with a modified cantilever edge beam 4". Furthermore, the heads on which the modified cantilever edge beam 4'" is supported are perimetral heads 7 which are supported by a respective inclined prop 18. In this embodiment, the modified cantilever edge beam 4'" is the same as the central beams 5 of the basic grids 10.

The perimetral head 7 of this embodiment comprises a central housing 70 with secure fixing system comprising a pin and a fork. The perimetral head 7 of this embodiment further comprises two corner housings 71, arranged orthogonal with respect to the central housing 70, and having the same characteristics as the housings 20 of the heads 2 of the basic grids 10. The perimetral head 7 also comprises a handrail housing 72 adapted for receiving the support of a handrail and a projection 73 in which a respective inclined prop 18 can be coupled.

In this embodiment, the ends of the main beams 3 are supported on the central housing 70 of the respective perimetral head 7, whereas the ends of the cantilever edge beam 4'" are supported on the corner housings 71 of the perimetral head 7.

To increased safety and to prevent the grid from being able to tilt, the main beams 3 of the cantilever grid 13 are fixed to the heads 2 by means of a respective fixing element. The side walls of the housings 20 of the head 2 comprise a fixing hole 26, whereas the main beams 3 comprise fixing holes 36 at the ends 3*a* thereof. The fixing holes 36 of the main beam 3 are flush with the fixing holes 26 of the housings 20 of the head 2 when the main beam 3 is coupled to the respective head 2 housing the coupling flange 21 of the head 2 in the respective coupling window. The fixing element goes through the fixing holes 26 and 36, providing a safe, anti-tilt fixing.

In this embodiment, the assembly of this transverse cantilever grid 13 after a pre-assembled basic grid 10 is performed in the following manner:

- The main beams 3 are first hanged on the heads 2 of the adjacent basic grid 10.
- A perimetral head 7 is then fixed at the opposite end of the main beams 3.
- A modified cantilever edge beam 4'" is then coupled between the perimetral heads 7.
- The assembly is then hoisted and shored up by means of props 18 which are coupled to the main beams 3 and to the perimetral heads 7.
- A plurality of central beams 5 are then arranged supported on the main beams 3. To that end, in this embodiment the ends of the central beams 5 are housed in housings 30 of the main beams 3.
- Finally, the attachment of the main beams 3 with the heads 2 is securely fixed by means of fixing elements.

A longitudinal cantilever grid 14 differs from the basic grids 10 in that the heads on which the main beam 3 arranged in a cantilever manner is supported are perimetral heads 7 supported by a respective inclined prop 18.

The cantilever grid 14 further comprises an additional main beam 3" which is arranged flush in the transverse direction with the slab on which the horizontal formwork 1 is arranged and which is fixed to an edge beam 4 with an inner head 2*a*. The additional main beam 3" is supported by a plurality of props 18. In this embodiment, the additional main beam 3" is the same as the main beam 3 of the basic grids 10. The central beams 5 of the grid 14 are also supported on the additional main beam 3" specifically on the support blocks 38.

The inner head 2*a* of this embodiment comprises two housings arranged at 180°, each of them being adapted for receiving the end of an additional main beam 3, 3". The inner head 2*a* of this embodiment comprises a U-shaped housing for coupling the inner head 2*a* to the edge beam 4. The inner head 2*a* also comprises a projection adapted for being coupled to a respective prop.

For increased safety, the edge beams 4 of the cantilever grid 14 are fixed to the heads 2 by means of a respective fixing element.

In this embodiment, the perimetral heads 7 and the fixing elements are the same as those used in the transverse cantilever grid 13.

In this embodiment, the assembly of this longitudinal cantilever grid 14 after a pre-assembled basic grid 10 is performed in the following manner:

- The edge beams 4 are first hanged on the heads 2 of the adjacent basic grid 10.
- A perimetral head 7 is then fixed at the opposite end of the edge beams 4.
- A main beam 3 is then coupled between the perimetral heads 7.
- The assembly is then hoisted and shored up by means of inclined props 18 which are coupled to the perimetral heads 7.
- A plurality of central beams 5 are then arranged supported on the main beams 3 and the attachment of the edge beams 4 with the heads 2 is securely fixed by means of fixing elements. In this embodiment, specifically the ends of the central beams 5 are housed in housings 30 of the main beams 3.
- Finally, an additional main beam 3" is arranged flush with the end of the slab on which the horizontal formwork 1 is arranged and is fixed to an edge beam 4 with an inner head which is shored up to the slab with a respective prop. A pair of additional props 18 are arranged for shoring up the additional main beam 3"

A cantilever vertex grid 15 is arranged between a transverse cantilever grid 13 and a longitudinal cantilever grid 14, in a cantilever vertex of the support base. The cantilever vertex grid 15 comprises a main beam 3 arranged flush in the transverse direction with the slab on which the horizontal formwork 1 is arranged and is fixed to the edge beam 4 which it shares with the longitudinal cantilever grid 14 by means of the inner head. The main beam 3 is supported by means of a plurality of props 18.

The cantilever vertex grid 15 further comprises a plurality of additional beams 6 that are supported on the main beam 3 which it shares with the transverse cantilever grid 13 and on the main beam 3 arranged flush in the transverse direction with the slab. Therefore, the formwork panels are supported on support surfaces 60 of the intermediate beams 6.

For increased safety, the additional beams 6 are fixed to the main beam 3 that the cantilever vertex grid 15 shares with the transverse cantilever grid 13 by means of a respective fixing element.

In this embodiment, the assembly of this cantilever vertex grid 15 is performed in the following manner:

- A main beam 3 is arranged flush in the transverse direction with the slab on which the horizontal formwork 1 is arranged and is coupled to the edge beam 4 which it shares with the longitudinal cantilever grid 14 by means of the inner head which is shored up to the slab with a respective prop 18.
- The main beam 3 is shored up by means of a plurality of props 18.
- A plurality of additional beams 6 are then arranged supported on the main beam 3 which it shares with the transverse cantilever grid 13 and on the main beam 3 arranged flush in the transverse direction with the slab.
- Finally, the additional beams 6 are fixed to the housings of the main beam 3 which it shares with the transverse cantilever grid 13 by means of a respective fixing element.

Figure 17:
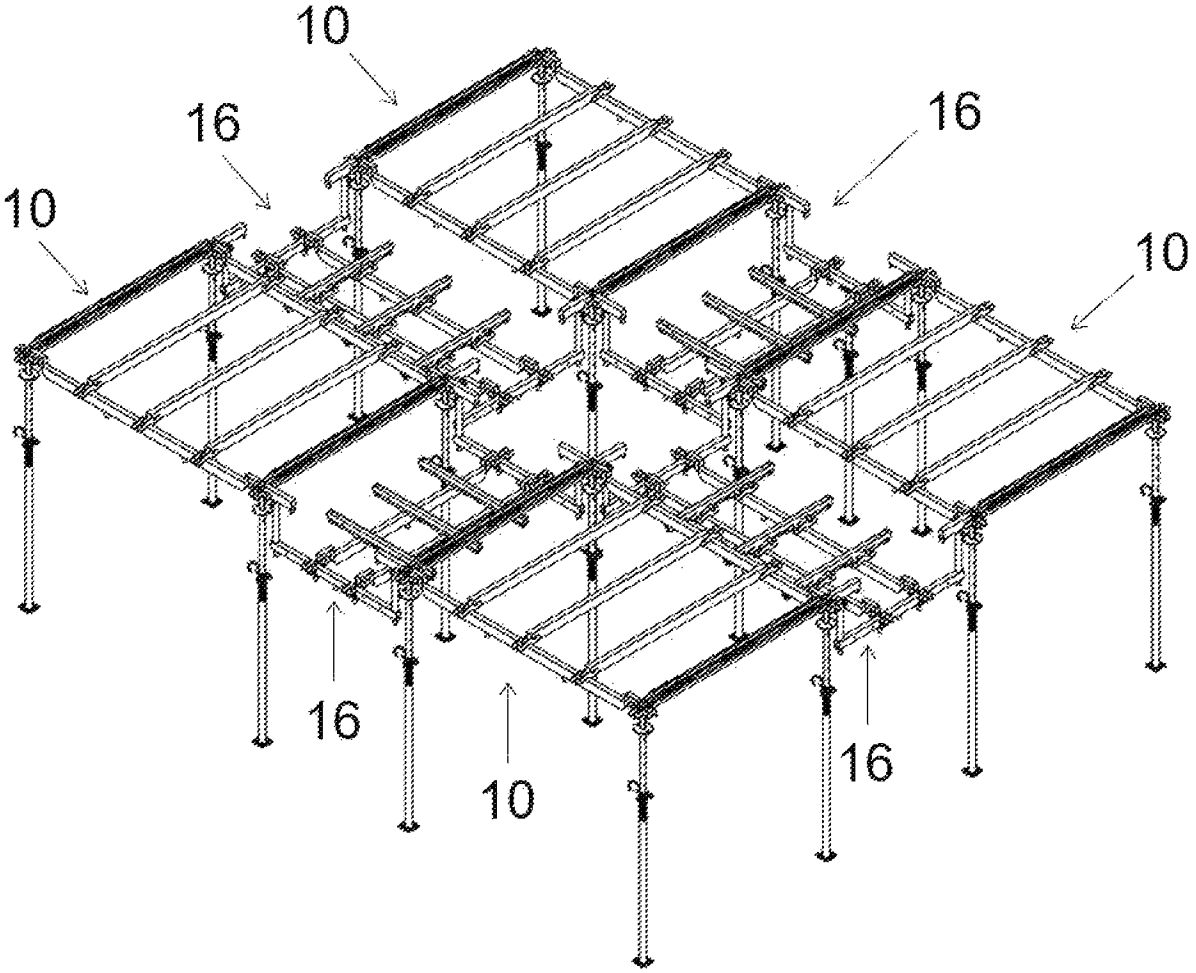
FIG. 17 shows a perspective view of the horizontal formwork according to a third embodiment of the invention, wherein the support base comprises, in addition to a plurality of basic grids, a plurality of grids for a hanging beam.
Figure 18:
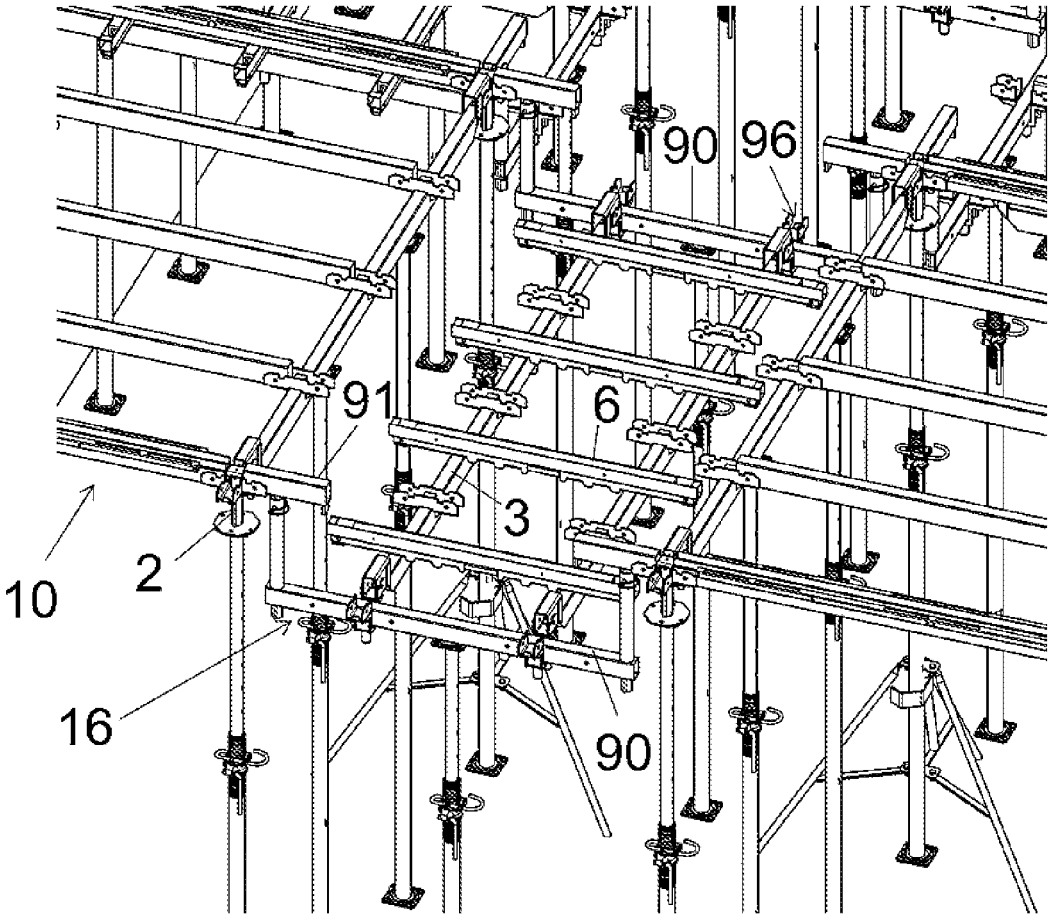
FIG. 18 shows a perspective view of a grid for a hanging beam of the horizontal formwork shown in FIG. 17.
Figure 19:
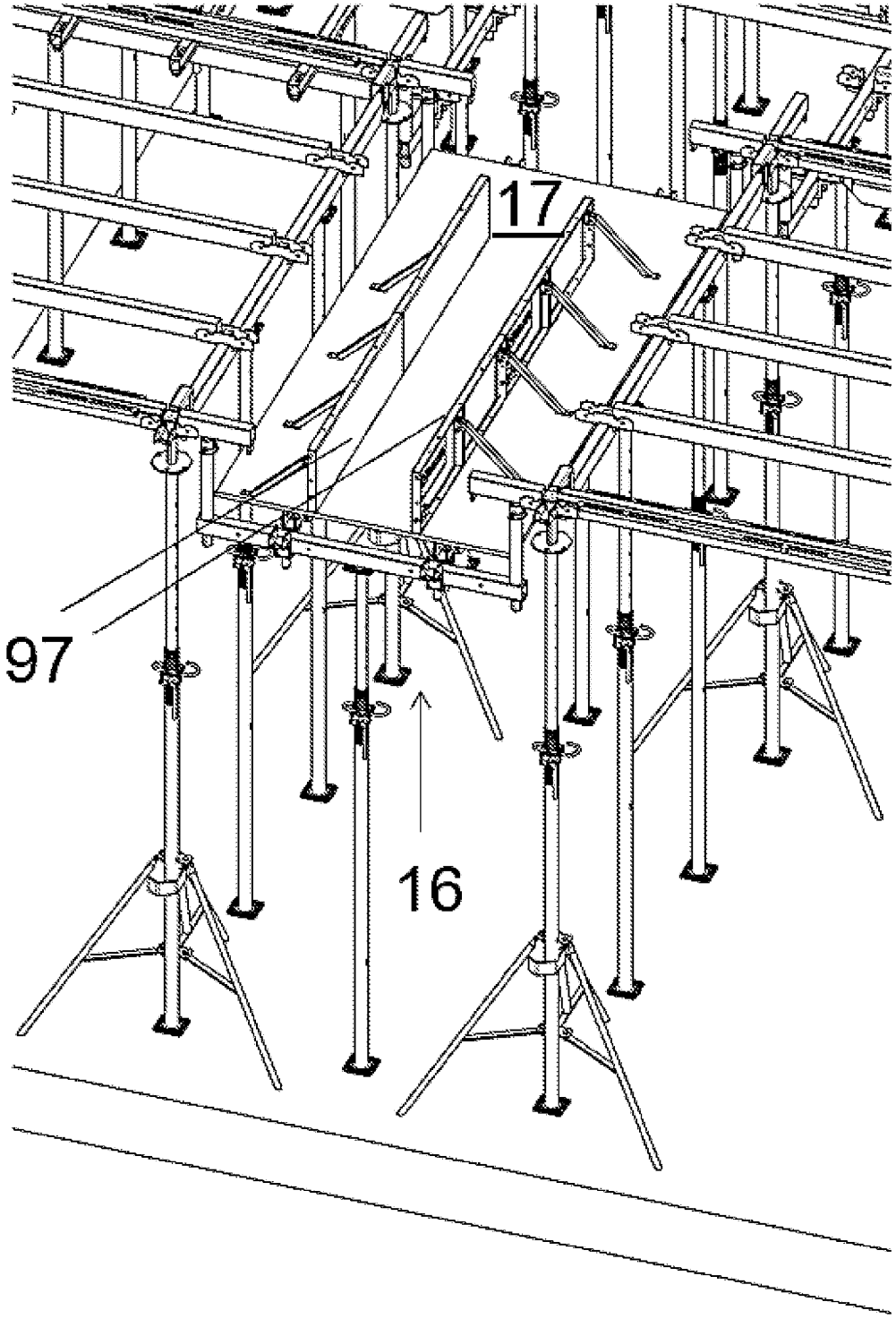
FIG. 19 shows a perspective view of a grid for a hanging beam with a formwork panel and two stop ends arranged on the grid.

FIG. 17 shows an embodiment of the support base comprising a plurality of grids for hanging beams 16 and FIG. 18 shows in detail one of the grids for hanging beams 16. Such grids are arranged between basic grids 10.

Figure 20:
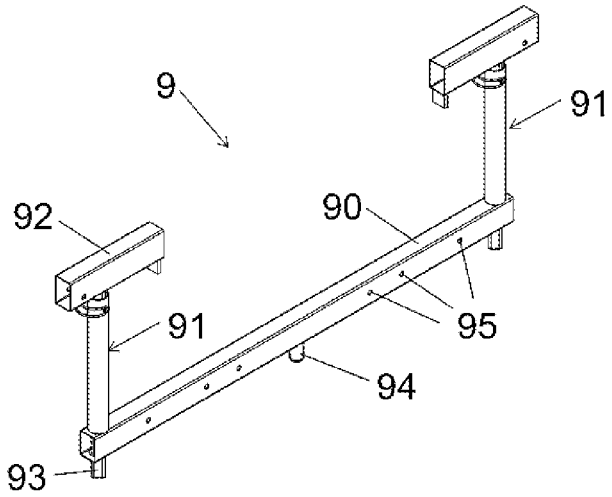
FIG. 20 shows a perspective view of a hanging beam support of a grid for a hanging beam shown in FIG. 18.

A grid for a hanging beam 16 comprises two hanging beam supports 9 which are arranged parallel to one another. A hanging beam support 9, shown in detail in FIG. 20, comprises a base 90 and a support 91 which is arranged at each end of the base 90. Each support 91 comprises a coupling element 92 and a telescopic shaft 93. The coupling element 92 is adapted for being supported both on the housing 20 of a head 2 of an adjacent basic grid 10, as shown in FIG. 17, and on a support surface 32 of a main beam 3 of the adjacent basic grid 10 or on a support surface 40' of a modified edge beam 4' of an adjacent edge grid 11. The telescopic shaft 93 of the support 91 has one of its ends fixed to an end of the base 90 and the other end fixed to the coupling element 92, and since it is telescopic, the distance between the two ends thereof can vary such that it allows carrying out hanging beams at different heights depending on the positioning of the telescopic shaft 93. The base 90 comprises a plurality of holes 95 in which a head with housings 96 can be fixed. In this embodiment, each head comprises two housings adapted for receiving the end of a respective main beam 3 and a U-shaped housing that fits in the base 90. In other embodiments, the base could have the housings incorporated therein. The base 90 of the hanging beam support 9 comprises a projection adapted for being coupled to a prop 18.

A grid for a hanging beam 16 also comprises at least two main beams 3 arranged parallel to one another and perpendicular with respect to the bases 90 of the hanging beam supports 9, the ends of the main beams 3 being housed in respective housings 96 of the hanging beam support 9. The main beams 3 are supported by a plurality of props 18. The main beams 3 of this embodiment are the same as the main beams 3 of the basic grids 10 so it is not considered necessary to describe them again. A grid for a hanging beam 16 also comprises a plurality of additional beams 6 which are supported on the main beams 3.

To carry out a hanging beam, in addition to arranging at least one formwork panel 17 on the support surfaces 60 of the additional beams 6, at least two stop ends 97 are arranged on the at least one panel formwork 17. The stop ends 97 are arranged parallel to one another and perpendicular with respect to the formwork panel 17 on which they are arranged. In this embodiment, brackets are used to fix the stop ends 97 to the corresponding formwork panel 17.

The stop ends 97 together with the formwork panel 17 demarcate the space for creating the hanging beams.

The following clauses disclose in an unlimited way additional embodiments, with each clause representing an embodiment.

Clause 1: A horizontal formwork comprising a support base and a plurality of formwork panels (17) which are supported on said support base, the support base comprising a plurality of basic grids (10), each basic grid (10) comprising four heads (2) arranged at the vertices of said basic grid (10), each head (2) being supported by a respective prop (18), two main beams (3) arranged parallel to one another, each end of said main beams (3) being supported on one of the heads (2), two edge beams (4) arranged parallel to one another and perpendicular to the main beams (3), each end of said edge beams (4) being supported on one of the heads (2), and a plurality of central beams (5) which are arranged parallel to the edge beams (4) and supported on the main beams (3), the main beams (3) comprising housings (30) adapted for receiving an end of a respective central beam (5), and the formwork panels (17) being supported on respective support surfaces (40, 50) of the edge beams (4) and the central beams (5), characterized in that at least one basic grid (10) comprises at least one main beam (3) comprising a plurality of support sections (31) for additional beams (6) for supporting the formwork panels (17), said support sections (31) comprising a support surface (32) for additional beams (6) which is arranged below the formwork panels (17), the support sections (31) thereby being adapted for allowing additional beams (6) to be supported on said support surface (32) projecting on both sides of the main beam (3), extending the support base by means of the portion of said additional beams (6) projecting out of the basic grid (10).

Clause 2: A horizontal formwork according to clause 1, wherein the main beams (3) comprising support sections (31) comprise an intermediate portion (3*b*) and two ends (3*a*), the housings (30) and the support sections (31) being in the intermediate portion (3*b*), the intermediate portion (3*b*) being arranged at a height lower than the ends (3*a*).

Clause 3: A horizontal formwork according to clause 2, wherein the intermediate portion (3*b*) of said main beams (3) comprises a support surface, the housings (30) being arranged on said support surface and the remaining of said support surface forming the support surfaces (32) of the support sections (31).

Clause 4: A horizontal formwork according to any of the preceding clauses, wherein all the main beams (3) of the basic grids (10) comprise a plurality of support sections (31) for additional beams (6) for supporting the formwork panels (17), said support sections (31) comprising a support surface (32) for the additional beams (6) which is arranged below the formwork panels (17), all the main beams (3) preferably being the same.

Clause 5: A horizontal formwork according to any of the preceding clauses, comprising a plurality of additional beams (6), each additional beam (6) being supported on a support surface (32) of a main beam (3) and on a second support surface external to the plurality of basic grids (10), said additional beams (6) extending the support base formed by said basic grids (10) longitudinally, said additional beams (6) preferably being arranged perpendicular to said main beam (3).

Clause 6: A horizontal formwork according to clause 5, wherein the second support surface of the additional beams (6) is a support surface of an additional support beam (3') supported by props (18), the additional support beam (3') preferably being the same as the main beam (3) on which the additional beams (6) are supported and the ends of said additional support beam (3') preferably being supported on respective heads (2') which are the same as the heads (2) of the basic grids (10).

Clause 7: A horizontal formwork according to any of the preceding clauses, wherein the edge beams (4) comprise at each longitudinal side the support surface (40) and an abutment wall (41) forming a bracket, said bracket being adapted for receiving the end of a formwork panel (17), such that the opposing brackets of the two edge beams (4) forming a basic grid (10) form a track for the formwork panels (17).

Clause 9: A horizontal formwork according to clause 7, wherein the edge beams (4) comprise a housing (42) adapted for receiving a filler (43), such that said filler (43) can fill the gap formed between two adjacent formwork panels (17).

Clause 10: A horizontal formwork according to any of the preceding clauses, wherein the support base comprises at least one edge grid (11) differing from the basic grids (10) in that at least one edge beam (4) is replaced with a modified edge beam (4') comprising a support surface (40') for additional beams (6) for supporting the formwork panels (17), said support surface (40') being arranged below the formwork panels (17), allowing said additional beams (6) to be supported on said support surface (40') projecting on both sides of the modified edge beam (4'), extending the support base by means of the portion projecting out of the edge grid (11), the horizontal formwork comprising a plurality of additional beams (6), each additional beam (6) being supported on a support surface (40') of a modified edge beam (4') and on a second support surface external to the plurality of grids (10,11), said additional beams (6) extending the support base formed by said grids (10,11) transversely.

Clause 11: A horizontal formwork according to clause 9, wherein the second support surface of the additional beams (6) is a support surface (40") of an additional support beam (4") supported by props (18), the additional support beam (4") preferably being the same as the modified edge beam (4') on which the additional beams (6) are supported and the ends of said additional support beam (4") preferably being supported on respective heads (2') which are the same as the heads (2) of the basic grids (10).

Clause 12: A horizontal formwork according to any of the preceding clauses, wherein the support base comprises at least one grid for bypassing a pillar (12), differing from the basic grids (10) in that, for bypassing a pillar arranged within said grid (12), at least two central beams (5) between which the pillar is arranged are replaced with modified central beams (5') comprising respective support surfaces (50') on which additional beams (6) are supported, the formwork panels (17) being supported on respective support surfaces (60, 40) of the additional beams (6) and the edge beams (4), and said additional beams (6) being arranged on both sides of the pillar.

Clause 13: A horizontal formwork according to any of the preceding clauses, wherein the support base comprises at least one transverse cantilever grid (13) differing from the basic grids (10) in that the edge beam (4) arranged in a cantilever manner is replaced with a modified cantilever edge beam (4") and that the heads on which said modified cantilever edge beam (4") is supported are perimetral heads (7), said modified cantilever edge beam (4") preferably being the same as the central beams (5).

Clause 14: A horizontal formwork according to any of the preceding clauses, wherein the support base comprises at least one longitudinal cantilever grid (14) differing from the basic grids (10) in that the heads on which the main beam (3) arranged in a cantilever manner is supported are perimetral heads (7), said grid (14) comprising an additional main beam (3") which is arranged flush with the end of the slab on which the horizontal formwork is arranged and is fixed to an edge beam (4) with an inner head and supported by a plurality of props (18), said additional main beam (3") comprising support surfaces (30") such that the central beams (5) of the grid (14) are also supported on said additional main beam (3").

Clause 15: A horizontal formwork according to clauses 12 and 13, comprising a cantilever vertex grid (15) which is arranged between a transverse cantilever grid (13) and a longitudinal cantilever grid (14), the cantilever vertex grid (15) comprising a main beam (3) arranged flush in the transverse direction with the slab on which the horizontal formwork is arranged and is fixed to the edge beam (4) which it shares with the longitudinal cantilever grid (14) by means of an inner head and is supported by means of a plurality of props (18) and a plurality of additional beams (6) that are supported on the main beam (3) which it shares with the transverse cantilever grid (13) and on the main beam (3) arranged flush in the transverse direction with the slab, such that the formwork panels are supported on support surfaces (60) of the intermediate beams (6).

Clause 16: A horizontal formwork according to any of the preceding clauses, wherein the support base comprises at least one grid for a hanging beam (16) comprising:

two hanging beam supports (9) which are arranged parallel to one another, each hanging beam support (9) comprising a base (90) comprising a plurality of housings (96) and a support (91) at each end of said base (90), and which are supported on a head (2) or a main beam (3) of an adjacent basic grid (10) or on a modified edge beam (6) of an adjacent edge grid (11), at least two main beams (3) the ends of which are housed in respective housings (96) of the hanging beam support (9), and a plurality of additional beams (6) which are supported on the main beams (3) and comprising a respective support surface (60), the horizontal formwork comprising at least one formwork panel (17) supported on the support surfaces (60) of said additional beams (6), and two stop ends (97) which are arranged perpendicularly on said at least one formwork panel (17).

What is claimed is:

1. A horizontal formwork comprising:

a plurality of formwork panels;

a support base comprising a plurality of basic grids on which the plurality of formwork panels are supported, each of the basic grids including first, second, third and fourth vertices and comprising;

first, second, third and fourth heads arranged respectively at the first, second, third and fourth vertices, each of the first, second, third and fourth heads being respectively supported by a first, second, third and fourth prop;

first and second main beams arranged parallel to one another, each of the first and second main beams having a first end and a second end, the first end of the first main beam being supported on the first head, the second end of the first main beam being supported on the second head, the first end of the second main beam being supported on the third head and the second end of the second main beam being supported on the fourth head, each of the first and second main beams including a plurality of housings disposed spaced apart from one another;

first and second edge beams arranged parallel to one another and perpendicular to the first and second main beams, each of the first and second edge beams having a first end and a second end, the first end of the first edge beam being supported on the first head, the second end of the first edge beam being supported on the third head, the first end of the second edge beam being supported on the second head and the second end of the second edge beam being supported on the fourth head, each of the first and second edge beams including one or more support surface for supporting the;

a plurality of central beams that are arranged parallel to the first and second edge beams, each of the plurality of central beams including a first end and a second end, the first end of each of the central beams being disposed in a respective housing of the first main beam, the second end of each of the central beams being disposed in a respective housing of the second main beam, each of the plurality of central beams including a support surface, the plurality of formwork panels being supported on the support surfaces of the first and second edge beams and the support surfaces of the plurality of central beams;

at least one of the first and second main beams of one of the plurality of basic grids including a plurality of support sections situated between adjacent central beams, the plurality of support sections each having a support surface, the support surfaces of the support sections being arranged a distance below the formwork panels that allows a plurality of first additional beams to be respectively supported on the support surfaces of the at least one of the first and second main beams in a manner that facilitates a projection of the first additional beams in a longitudinal direction out of the basic grid to increase the support area, the plurality of first additional beams being supported on the respective support surfaces of the at least one of the first and second main beams, the additional beams projecting in the longitudinal direction out of the basic grid to increase the support area, each of the additional beams projecting on both sides of the at least one of the first and second beam.

2. The horizontal formwork according to claim 1, wherein each of the first additional beams have a same length.

3. The horizontal formwork according to claim 1, wherein the first additional beams project in the longitudinal direction out of the basic grid by different amount.

4. The horizontal formwork according to claim 2, wherein the first additional beams project in the longitudinal direction out of the basic grid by different amount.

5. The horizontal formwork according to claim 1, wherein all of the first and second main beams of the plurality of basic grids comprise a plurality of support sections that are capable of supporting additional beams, each of the support sections comprising a support surface that is arranged a distance below the formwork panels.

6. The horizontal formwork according to claim 3, wherein all the first and second main beams in the plurality of basic grids are the same.

7. The horizontal formwork according to claim 1, wherein the first additional beams are arranged perpendicular to the at least one of the first and second main beams.

8. The horizontal formwork according to claim 1, wherein at least some of the first additional beams are also supported by a support surface that is located outside the plurality of basic grids.

9. The horizontal formwork according to claim 1, wherein each of the first additional beams has an end that is supported on a support surface located outside the plurality of basic grids.

10. The horizontal formwork according to claim 8, wherein the support surface located outside the plurality of basic grids is comprised in a beam that is the same as the at least one of the first and second main beams.

11. The horizontal formwork according to claim 10, wherein the beam is arranged non-parallel to the first and second main beams.

12. The formwork according to claim 10, further comprising fifth and sixth heads that are each located outside the plurality of basic grids, the beam having a first end supported on the fifth head and a second end supported on the sixth head, each of the fifth and sixth heads being respectively supported by a fifth prop and a sixth prop.

13. The horizontal formwork according to claim 12, wherein each of the first, second third, fourth, fifth and sixth heads are the same.

14. The horizontal formwork according to claim 1, wherein the first and second edge beams further comprise an abutment wall that extends vertically upward from the support surface to form a bracket in which the formwork panels are capable of sliding in the longitudinal direction.

15. The horizontal formwork according to claim 14, wherein the first and second edge beams comprise a housing configured to receive a filler to fill a gap formed between two adjacent formwork panels.

16. The horizontal formwork according to claim 1, wherein the support base includes at least one edge grid, the edge grid comprising:

first and second formwork panels;

first, second, third, fourth, fifth and sixth heads, each of the first, second, third, fourth, fifth and sixth heads being respectively supported by a first, second, third, fourth, fifth and sixth prop;

first and second main beams arranged parallel to one another, each of the first and second main beams having a first end and a second end, the first end of the first main beam being supported on the first head, the second end of the first main beam being supported on the second head, the first end of the second main beam being supported on the third head and the second end of the second main beam being supported on the fourth head, each of the first and second main beams including a plurality of housings disposed spaced apart from one another;

first, second and third edge beams arranged parallel to one another and perpendicular to the first and second main beams, the first edge beam having a first end and a second end, the first end of the first edge beam being supported on the second head, the second end of the first edge beam being supported on the fourth head, the first end of the second edge beam being supported on the first head and the second end of the second edge beam being supported on the third head, the first and second edge beams being separated from one another in a transverse direction by a first distance, the second and third edge beams being separated from one another in the transverse direction by a second distance that is less than the first distance, each of the first, second and third edge beams respectively including first, second and third support surfaces, the second and third support surfaces being located a distance below the first support surface;

a plurality of second additional beams each of the second additional beams being supported on both the second support surface of the second edge beam and the third support surface of the third edge beam; the second additional beams projecting on both sides of the second and third edge beams, the second additional beams having a support surface;

a plurality of central beams that are arranged parallel to the first and second edge beams, each of the plurality of central beams including a first end and a second end, the first end of each of the central beams being disposed in a respective housing of the first main beam, the second end of each of the central beams being disposed in a respective housing of the second main beam, each of the plurality of central beams including a support surface;

the first formwork panel being supported on the support surface of the first edge beam, the support surfaces of the central beams and the support surfaces of the second addition beams, the second formwork panel being supported on the support surfaces of the second additional beams.

17. The horizontal formwork according to claim 16, wherein the second additional beams are arranged perpendicular to the second and third edge beams.

18. The horizontal formwork according to claim 16, wherein each of the first, second, third, fourth, fifth and sixth heads are the same.

19. The horizontal formwork according to claim 16, wherein each of the second additional beams has a same length.

20. The horizontal formwork according to claim 16 wherein the first edge beam forms a part of one of the plurality of basic grids.

* * * * *